US006082586A

United States Patent [19]

Banks

[11] Patent Number: 6,082,586

[45] Date of Patent: Jul. 4, 2000

[54] LIQUID DISPENSER FOR DISPENSING FOAM

[75] Inventor: Stewart Banks, Brantford, Canada

[73] Assignee: Deb IP Limited, Derbyshire, United Kingdom

[21] Appl. No.: 09/050,130

[22] Filed: Mar. 30, 1998

[51] Int. Cl.[7] ..... B65D 35/28

[52] U.S. Cl. ..... 222/95; 222/105; 222/145.5; 222/181.3; 222/189.11; 222/190; 222/325

[58] Field of Search ..... 222/95, 105, 145.5, 222/181.3, 189.06, 189.11, 190, 325, 340, 383.1

[56] References Cited

U.S. PATENT DOCUMENTS

| | | | |
|---|---|---|---|
| 3,422,993 | 1/1969 | Boehm et al. | 222/190 |
| 3,709,437 | 1/1973 | Wright | 222/190 |
| 3,743,146 | 7/1973 | Schindler | 222/446 |
| 3,985,271 | 10/1976 | Gardner | 222/190 |
| 4,019,657 | 4/1977 | Spitzer et al. | 222/136 |
| 4,022,351 | 5/1977 | Wright | 222/145 |
| 4,238,056 | 12/1980 | Tucker et al. | 222/181.2 |
| 4,621,749 | 11/1986 | Kanfer | 222/153 |
| 4,978,036 | 12/1990 | Burd | 222/207 |
| 5,048,750 | 9/1991 | Tobler | 222/189 |
| 5,156,307 | 10/1992 | Callahan et al. | 222/189 |
| 5,165,577 | 11/1992 | Ophardt | 222/181 |
| 5,174,476 | 12/1992 | Steiner et al. | 222/181 |
| 5,248,066 | 9/1993 | Olson et al. | 222/105 |
| 5,289,952 | 3/1994 | Gueret | 222/189 |
| 5,372,281 | 12/1994 | Palmer et al. | 222/325 |
| 5,425,404 | 6/1995 | Dyer | 222/325 |
| 5,445,288 | 8/1995 | Banks | 222/95 |

FOREIGN PATENT DOCUMENTS

| | | |
|---|---|---|
| 0392238 | 3/1990 | European Pat. Off. . |
| 0565713 | 5/1992 | European Pat. Off. . |
| 0618147 | 8/1993 | European Pat. Off. . |
| 4429454 | 2/1996 | Germany . |
| 2193904 | 7/1987 | United Kingdom . |

*Primary Examiner*—Joseph A. Kaufman
*Attorney, Agent, or Firm*—Lynn C. Schumacher; Hill & Schumacher

[57] ABSTRACT

There is disclosed a foaming device for dispensing foam. The device includes a collapsible liquid container and a foam pump attached to the container outlet. The foam pump includes two enclosures, the first being bonded in the throat of the container and the second being telescopingly received in the first with a flexible seal mounted on the second enclosure to provide an air tight seal. When assembled, the two enclosures define an air chamber and a fluid chamber each having outlets which merge by the foamer outlet. The fluid chamber accepts liquid from the container and when the second member is moved with respect to the first member the fluid chamber is pressurized to open an outlet valve and air is simultaneously expelled through the outlet. The liquid and air commingle as they pass through a wire, plastic or fabric mesh thereby forming the foam. There is included a dispenser housing for releasibly receiving the collapsible liquid container and foam pump. The dispenser includes a push button pivotally attached thereto which is coupled to the second enclosure so that as the push button is moved the pump is actuated.

17 Claims, 8 Drawing Sheets

LIQUID DISPENSER FOR DISPENSING FOAM

FIELD OF THE INVENTION

The present invention relates to dispensers for liquids, and more particularly to dispensers which dispense the liquid as a foam.

BACKGROUND OF THE INVENTION

Liquid dispensers for dispensing soaps and the like are well known. A large number of dispensers for dispensing for example hand cleaning soaps dispense the liquid itself. In many applications it is preferable to dispense the soap in the form of a foam. Foams tend to be much easier to spread than the corresponding liquid and in addition there is much less waste due to splashing or run-off since the foam has a much higher surface tension than the liquid. A foam requires much less liquid to produce the same cleaning power as obtained with the un-foamed liquid due to the much higher surface area of the former.

Known prior art foaming devices are generally of two types. In the first type of foamer, such as disclosed in U.S. Pat. Nos. 4,019,657 and 3,709,437 the foam is produced by a jet of air. A disadvantage of this first type of foamer is that the quality of the foam varies as the dispensing force is varied.

The second type of foam dispenser, as disclosed in U.S. Pat. Nos. 3,422,993 and 3,985,271 uses a porous material through which the foamable liquid is pumped thereby mixing the liquid with air to form the foam. Drawbacks to this type of foamer is that a considerable amount of pressure is required to force the liquid through the porous material. A further drawback to both types of foam dispensers is that the foamer is located at the top of the dispenser and a tube extends down to the bottom of the liquid storage container so that considerable force must be applied to pump the liquid up into the foamer and to dispense it therefrom.

Examples of other dispensers constructed on this principle are disclosed in EP-A-392 238, EP-A-565 713 and EP-A618 147 are all directed to liquid dispensers comprising a bottle with a hand operated pump in the neck of the bottle. Each of the devices disclosed in these references include a hose which extends to the bottom of the bottle so that the liquid must be pumped up against gravity into the mixing chamber. As stated above, a major disadvantage to these configurations is that as the liquid is depleted greater force must be exerted in the pumping procedure in order to raise the liquid from the bottom of the container during dispensing of the liquid. These types of dispensers are also limited in the sense that they must be used in the upright vertical position.

In many of the prior art foaming devices the foamer unit is separate from the container holding the liquid. When the liquid container is replaced the operator generally has to interconnect the foamer unit with the liquid container which can be an inconvenience. It would therefore be advantageous to provide a foam dispenser which allows convenient and rapid replacement of the liquid container in the dispenser.

Liquid detergents or soaps for hand cleaning generally require preservatives to increase shelf life of the detergent. Antioxidants are typically present as an additive to reduce oxidation of the soap in the presence of air normally present in the soap container and this adds to the cost of the soap. In the presence of air many soaps tend to thicken which requires increasing force to dispense the liquid. The thickened liquid is prone to clogging up the dispensing pathway.

The dispenser bottles disclosed in EP-A-392 238, EP-A-565 713 and EP-A-618 147 are all vented to prevent negative pressure in the bottles from building up as liquid is pumped out of the bottles. Commonly owned U.S. Pat. No. 5,445,288 discloses a foaming device using a collapsible container.

Accordingly, it would be advantageous to provide a dispenser which produces and dispenses a liquid in the form of foam and in which the liquid is not exposed to air until expelled from the liquid container portion of the dispenser.

SUMMARY OF THE INVENTION

It is an object of the present invention to provide a dispenser for dispensing foam which is self cleaning and sealed so that the liquid contained within the dispenser is not exposed to air until it is expelled from the liquid container portion of the dispenser.

The present invention provides a device for producing and dispensing foam, comprising a collapsible container having an interior and a throat and a pump means attached to the container. The pump means includes a first enclosure member sealed in the throat with an air-tight seal, a second enclosure member and a flexible seal member attached to the second enclosure member on an outer surface there of. The second enclosure member is engaged in the first enclosure member and telescopingly movable therein. The first and second enclosure members cooperate to define an air chamber and a flow passageway and the flexible seal provides an air seal between the first and second enclosure members. The flow passageway is in flow communication with the interior of the collapsible container and the air chamber is in communication with a mixing chamber. The device includes a fluid inlet valve for admitting liquid into the flow passageway from the container interior and a fluid outlet valve in the flow passageway for flow of liquid from the flow passageway into the mixing chamber. The device includes an outlet passageway communicating with the mixing chamber, and a porous member located in the mixing chamber downstream from the fluid outlet valve for generating turbulence in commingled air and liquid passing therethrough. Moving the second enclosure member towards the first enclosure member reduces volume of the air chamber and the volume of the flow passageway and pressurizes air in the air chamber and liquid in the flow passageway and forces commingled air and liquid through the porous member to form a foam expelled through the outlet passageway.

BRIEF DESCRIPTION OF THE DRAWINGS

The following is a description, by way of example only, of the liquid dispenser for dispensing foam forming the present invention, reference being had to the accompanying drawings, in which.

Figure 1:
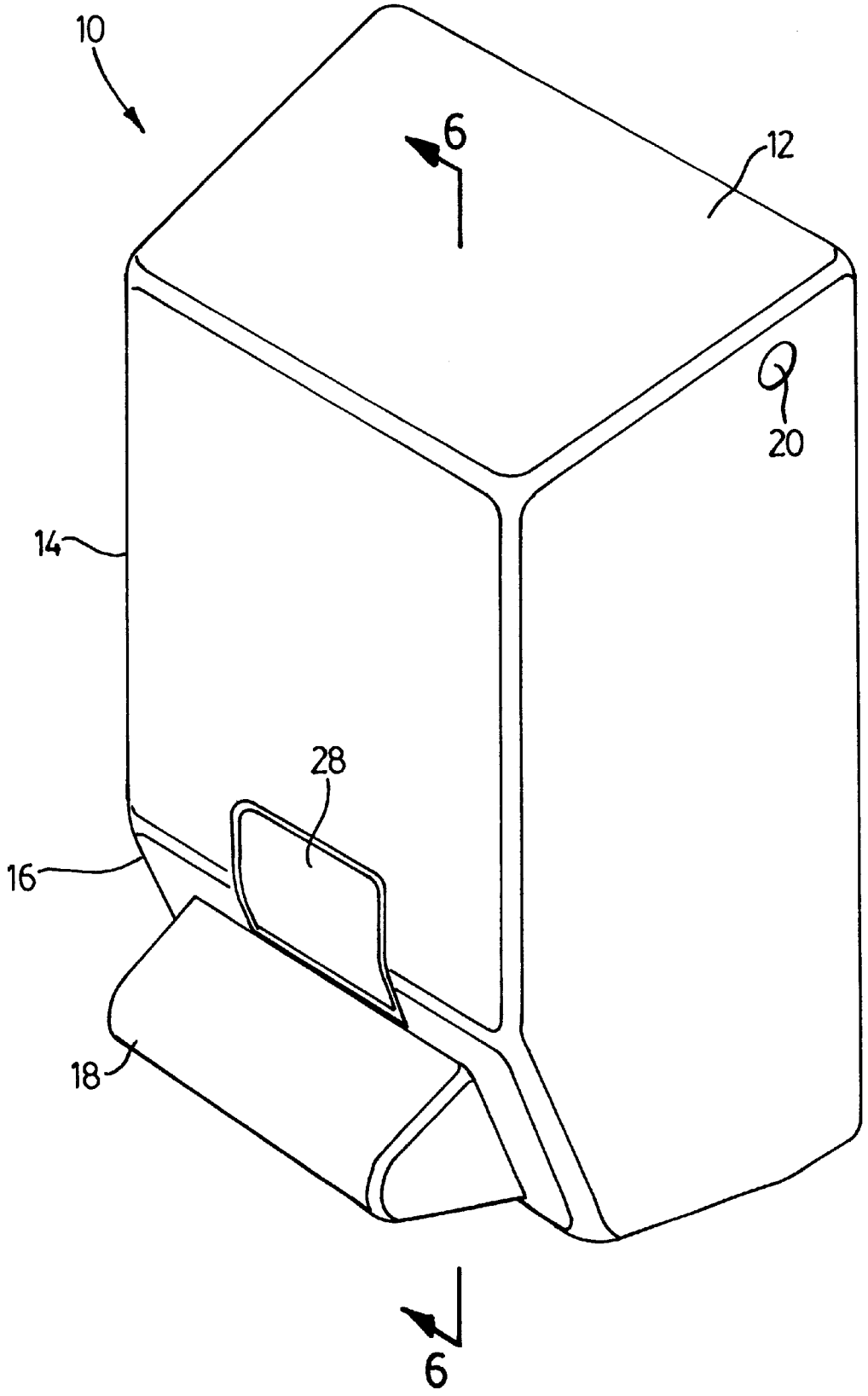
FIG. 1 is a perspective view of a dispenser housing constructed in accordance with the present invention.
Figure 5:
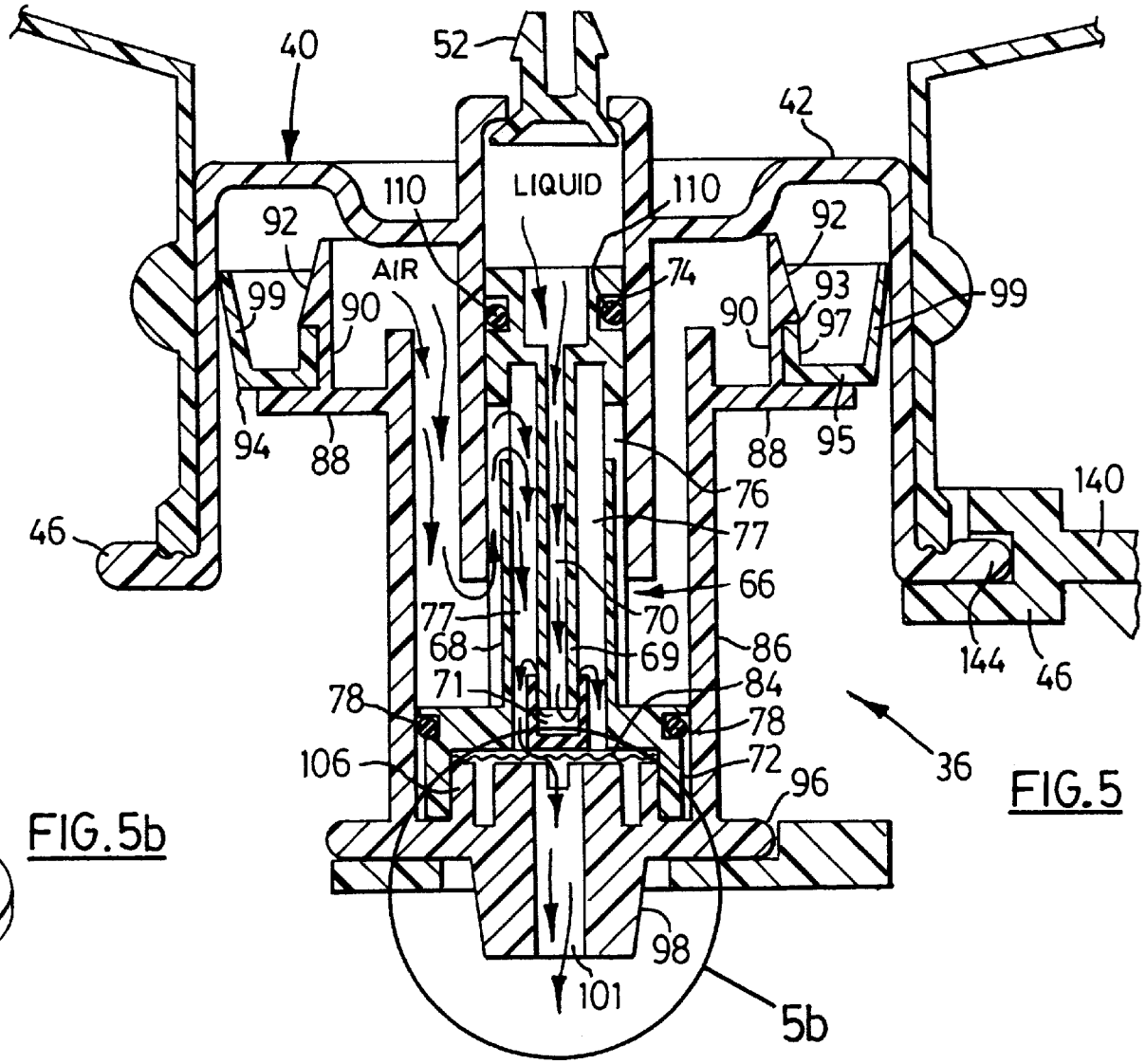
FIG. 5 is a view similar to FIG. 4 but showing the pump in the actuated position for expelling foam from the dispenser.
Figure 6:
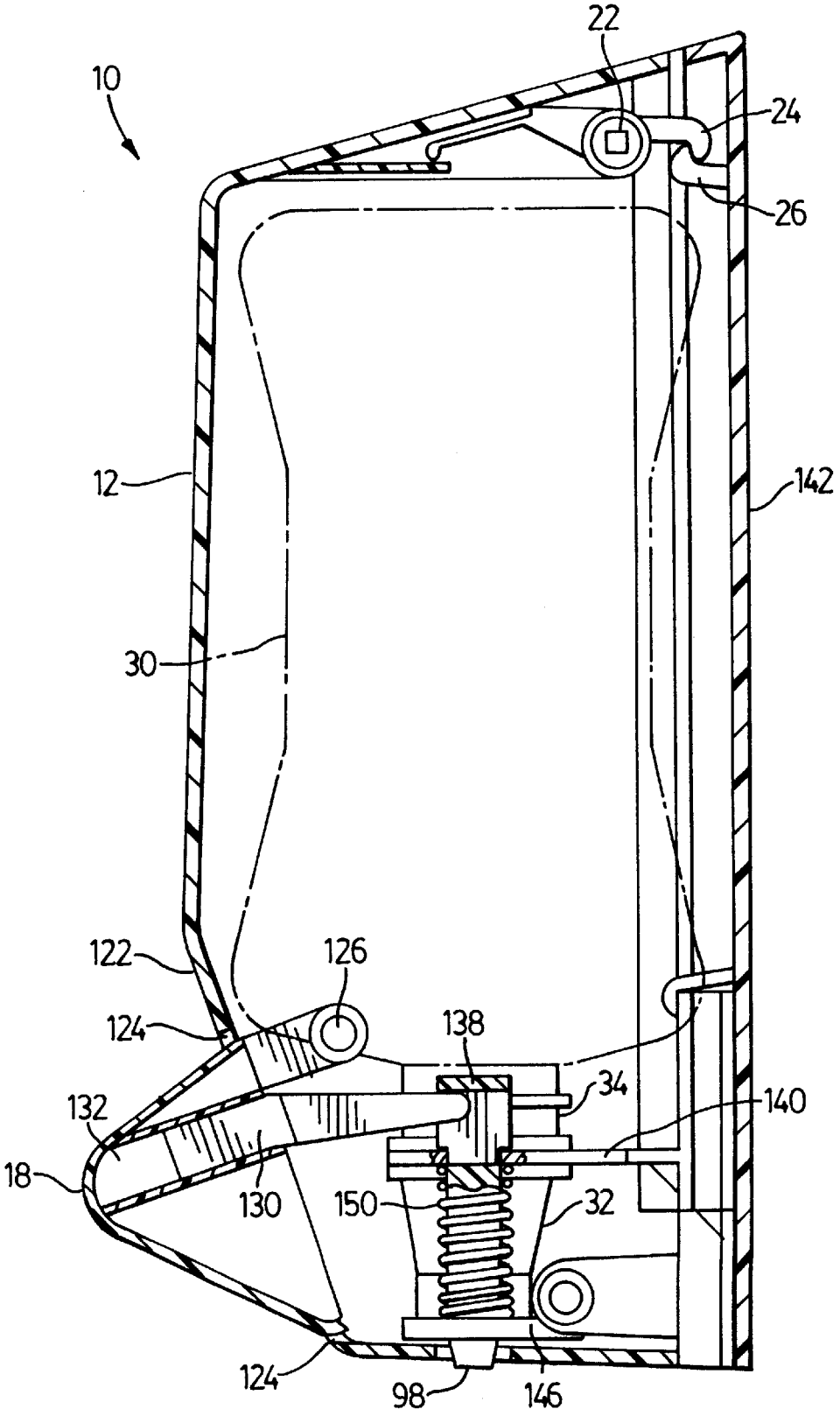
Figure 7:
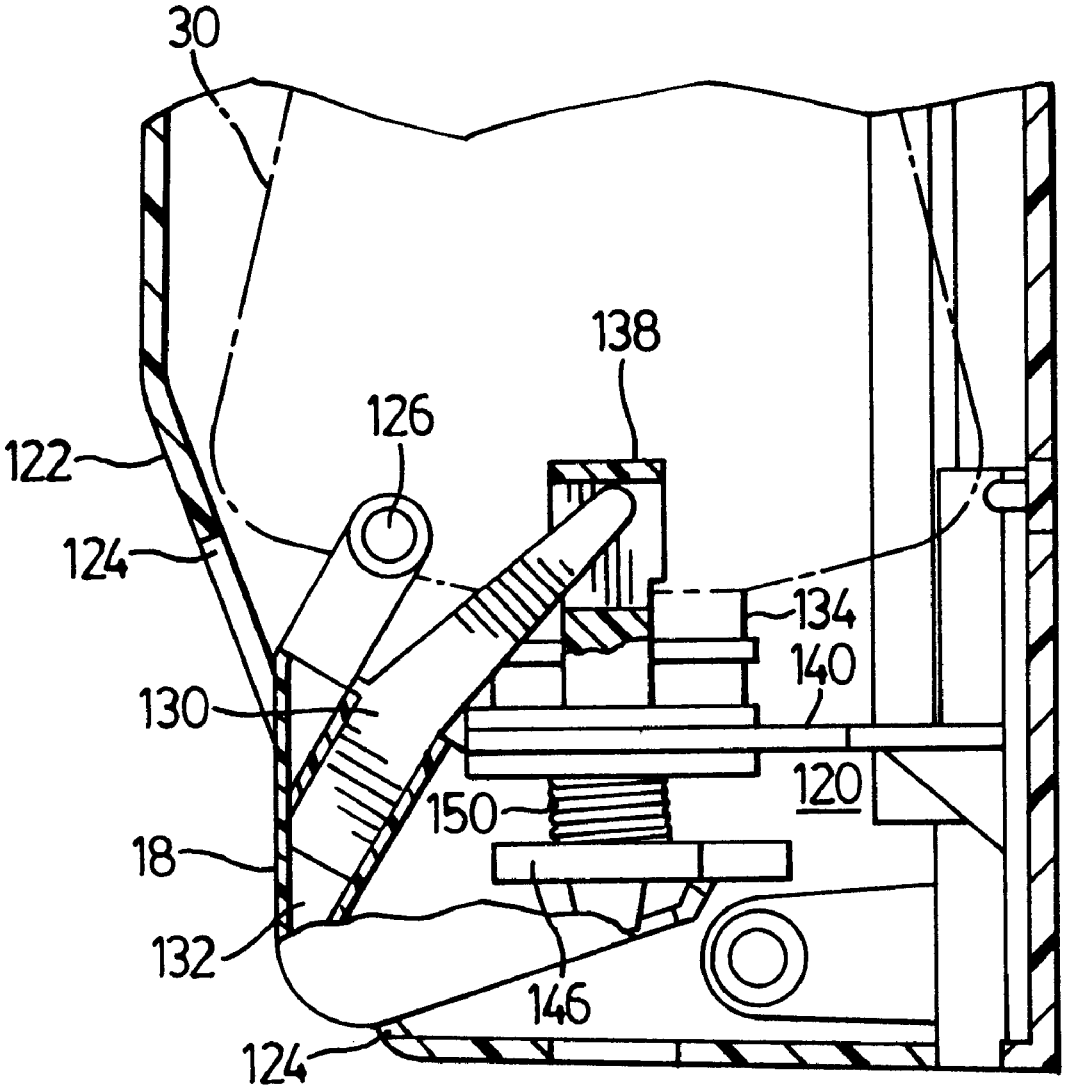
Figure 8:
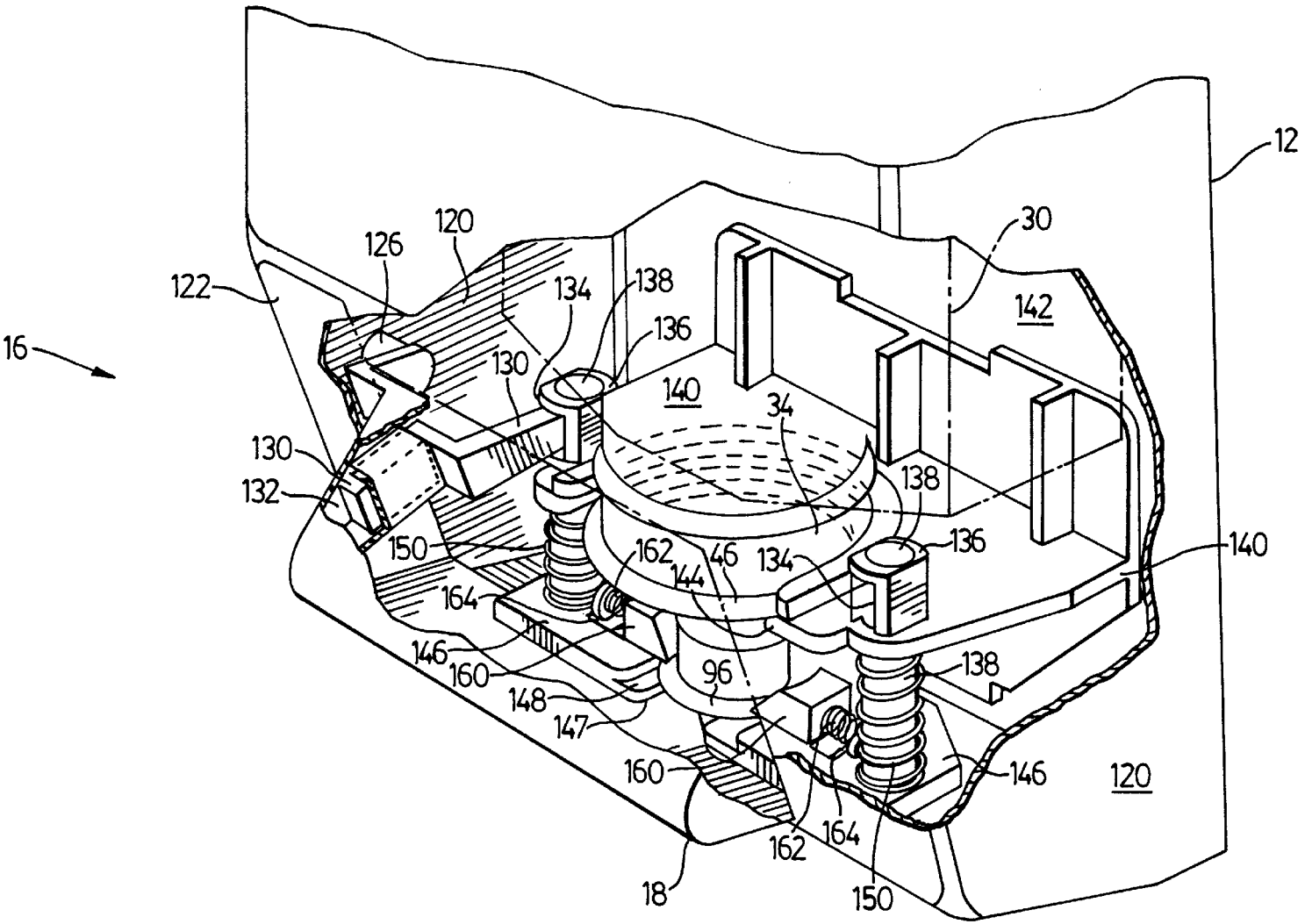

FIG. **5*b* is a detailed view of the portion 5*b* of FIG. 5**;

FIG. 6 is a sectional view along the line 6—6 of FIG. 1;

FIG. 7 is a sectional view similar to FIG. 6, but broken away and showing the pump in the depressed position; and FIG. 8 is a perspective view, broken away, of a portion of the dispenser housing containing the foam pump.

DETAILED DESCRIPTION OF THE INVENTION

Referring first to FIG. 1, a liquid dispenser containing a dispenser constructed in accordance with the present invention is shown generally at 10. Dispenser 10 includes a housing 12 enclosing an upper liquid dispenser compartment 14 and a lower compartment 16 housing a foam producing pump to be discussed below. A hand actuated lever or pushbutton 18 is pivotally attached to lower compartment 16. An aperture 20 is located in the side of housing 12 for allowing access to a locking mechanism which locks the generally rectangular housing to a back plate (not shown) which is secured to a support surface such as a wall. A view port 28 is provided on the front of housing 12 for viewing the liquid level in the liquid container.

Figure 2:
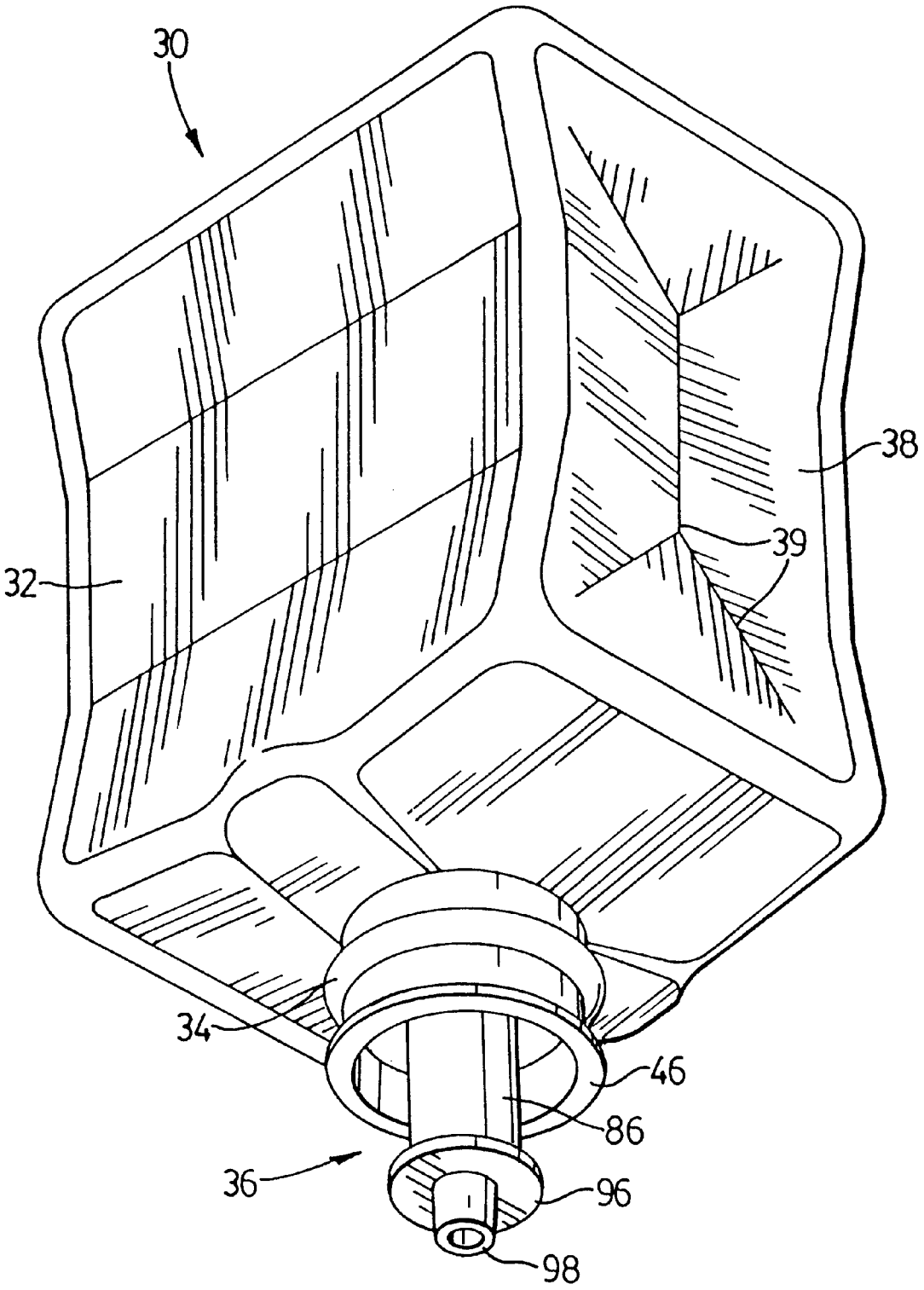
FIG. 2 is a perspective view of a liquid container and foam pump attached thereto.

Dispenser 10 is designed to releasibly receive therein a liquid container shown generally at 30 in FIG. 2 comprising a liquid storage compartment 32 and a liquid outlet or throat 34. Attached in the throat 34 of container 30 is a foam pump shown at 36. Container 30 is a flexible plastic container for holding liquids such as soap and the like and is collapsible. Container 30 is gusseted along the sides 38 thereof so that as liquid is drained the container collapses along creases 39 to form an I beam section. A view port 28 is provided on the front of housing 12, best seen in FIG. 1, for viewing the liquid level in liquid container 30 when the latter is assembled with the housing.

Figure 3:
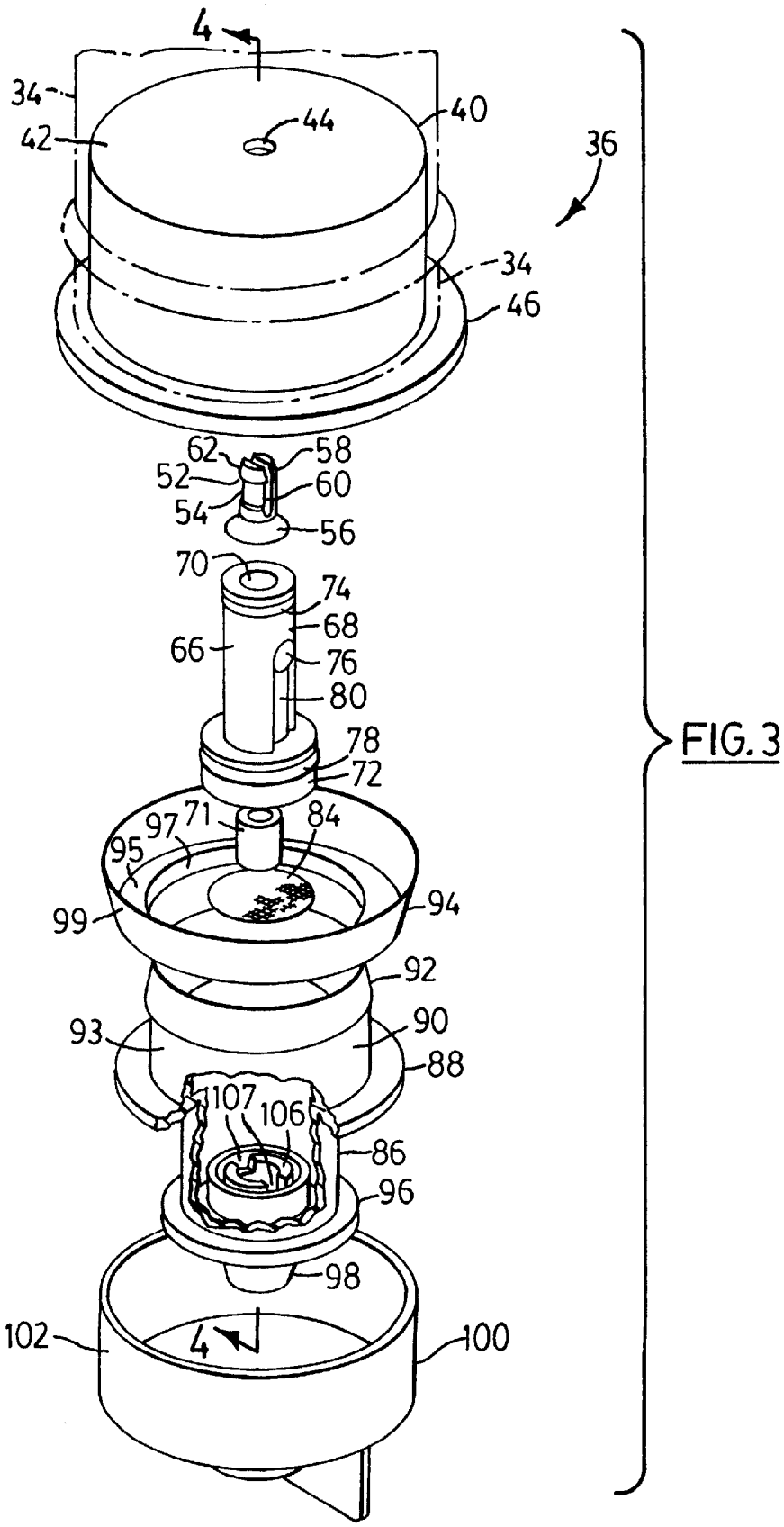
FIG. 3 is an exploded perspective view of the foam pump of FIG. 2.
Figure 4:
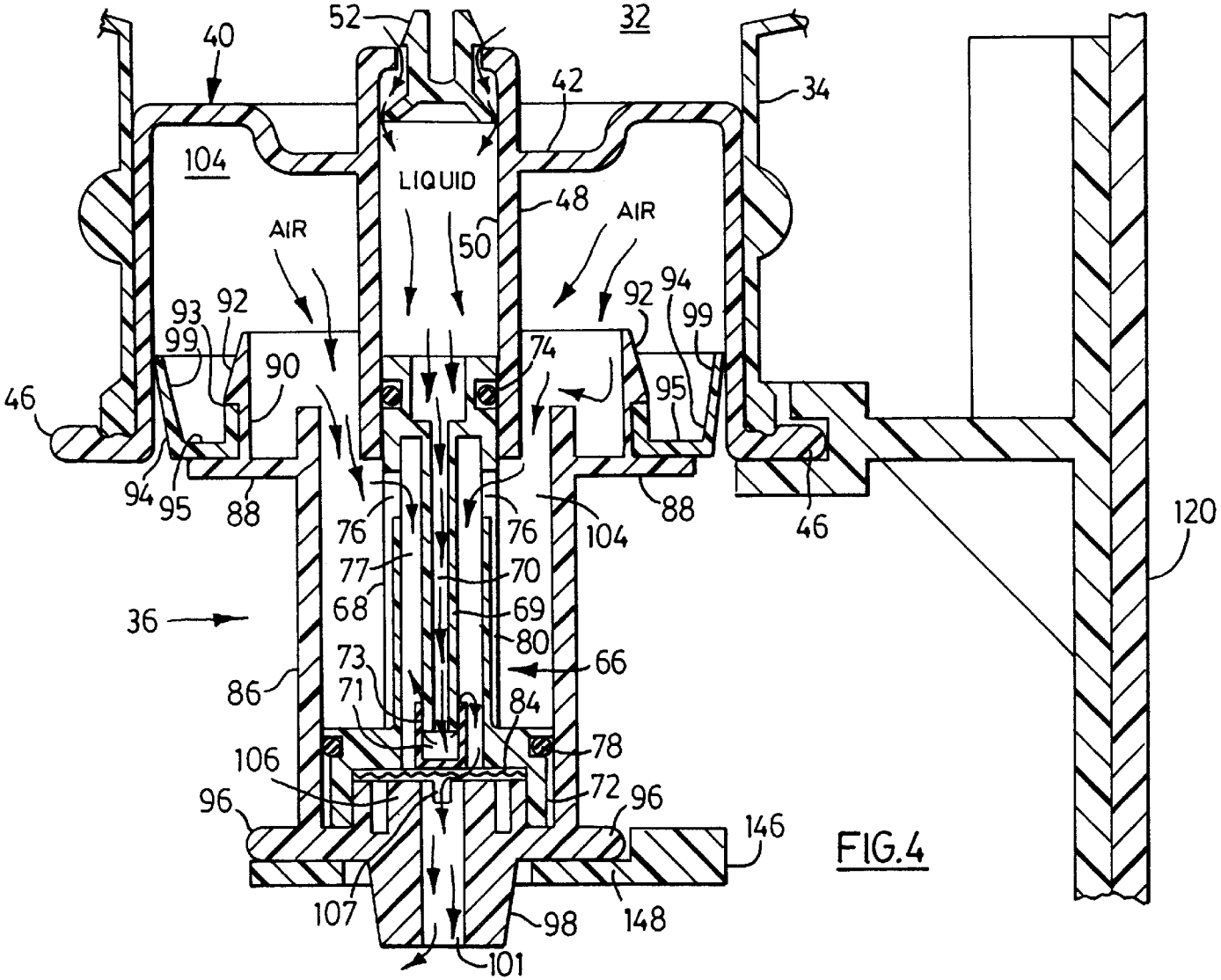
FIG. 4 is a cross sectional view taken along the line 4—4 of FIG. 3 when the foam pump is assembled and with the pump in the unactuated position.

The exploded view of FIG. 3 illustrates the components from which foam pump 36 is constructed and FIGS. 4 and 5 illustrate the assembled foamer in the two extreme positions. Foam pump 36 includes a cup-shaped enclosure member 40 having a top portion 42 with an aperture or fluid inlet 44 centrally located therein. Enclosure 40 includes a shoulder 46 against which the edge of throat 34 of container 30 (shown in ghost outline) abuts when pump 36 is assembled with container 30. Aperture 44 forms a fluid inlet for liquid entering pump 36 from compartment 32 to be discussed later. A cylindrical tube 48 (visible only in FIGS. 4 and 5) is attached to the top portion 42 on the interior of enclosure member 40 and encloses a passageway 50 in flow communication with bottle interior 32.

Foam pump 36 is provided with an inlet valve 52 comprising a valve stem 54 and a valve head 56. Stem 54 is in the shape of a tuning fork with two spaced arms 58 depending from head 56 and defining a slot 60 therebetween. The end portions of arms 58 spaced from valve head 56 are provided with shoulders 62. When assembled as seen in FIGS. 4 and 5, inlet valve 52 is located in aperture 44 and retained therein by shoulders 62 and valve head 56 extending laterally beyond the edge of the aperture.

Foam pump 36 includes a piston 66 provided with a cylindrical outer tube and a piston head 72 attached to one end of outer tube 68 and the other end of the shaft is provided with an O-ring 74 seated in an O-ring groove. Air vent inlet and outlet holes or apertures 76 are shown disposed about outer tube 68 spaced away from piston head 72. Piston head 72 is provided with an O-ring groove and an O-ring 78 is located in the groove extending circumferentially around piston head 72. Outer tube 68 is provided with cut-out sections 80 that extend from holes 76 down to piston head 72. Pump 36 includes a wire gauze, grid or mesh 84. Mesh 84 may be fabricated of plastic, wire or cloth material. Mesh 84 produces turbulence in the air-liquid mixture to aid in foam production.

The interior structure of piston 66 will now be discussed with specific reference to FIGS. 4 and 5. Piston 66 includes an inner cylindrical tube 69 which is concentric, and integrally formed with outer tube 68 at the upper ends of tubes 68 and 69 which face valve 52 into the interior compartment 32 of bottle 30. Inner tube 69 defines a passageway 70 through piston 66. Outer and inner tubes 68 and 69 respectively define an annular mixing chamber 77 between the tubes. A top hat valve 71 is fitted over the free end of inner tube 69 located in piston head 72 and valve 71 controls the flow of liquid from passageway 70 into mixing chamber 77. Top hat valve 71 is made of a flexible rubber or plastic having a desired elasticity so that it expands under pressure of the liquid to permit liquid to flow out around edge 73 as cylinder 86 is being pushed upwardly into cylinder 40.

Referring to FIGS. 3, 4 and 5, pump 36 further includes a second and opposing enclosure member which is slideably mounted within the first enclosure member and which includes a cylindrically shaped hollow cylinder 86 having an open end with a shoulder 88 spaced from the open upper end of the cylinder. Cylinder 86 includes a second cylindrically shaped member 90 with a larger diameter than cylinder 86 and concentric therewith and extending upwardly from shoulder 88. Cylindrical member 90 is provided with a chamfered upper end portion 92 which defines a circumferential slot 93. A flexible, cylindrical seal 94 includes a horizontal section 95 and a section 97 vertically upstanding from the inner edge of section 95 and a section 99 angled upwardly and outwardly from the outer edge of section 95. The vertically upstanding section 97 snaps into circumferential slot 93 when flexible seal 94 is assembled with cylinder 86.

Figure 5B:
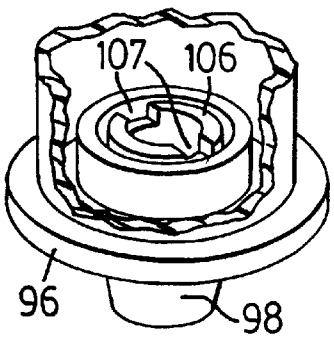

Referring again specifically to FIGS. 4 and 5, a circumferential rib 96 extends around the lower end of cylinder 86 and an outlet 98 is integrally formed with cylinder 86. Outlet 98 defines a passageway 101 that communicates with passageway 70 and includes a castellated web 106 which has an outer diameter sufficiently small to be received within piston head 72 and large enough to support mesh 84. When pump 36 is assembled, mesh 84 is received within piston head 72 and piston 66 is inserted into cylinder 86 with mesh 84 supported on web 106. Top hat valve 71 is pushed part way onto the end portion of inner cylinder 69 with mesh 84 located between the end of valve 71 and web 106. The castellated portion of web 106 comprises slots 107 to permit exit of foam through outlet passageway 101, see FIGS. 4 and 5*b*.

Cylinder 86 is received within cup-shaped cylindrical enclosure 40 and the outer diameter of flexible seal 94 is chosen to ensure a friction fit but which allows cylinder 86 to be telescoped with respect to cylindrical enclosure 40. The presence of flexible seal 94 is very advantageous because it provides a better seal which permits superior pressurizing of the air chamber than is achieved with similar structures absent the seal. Tube 68 is received within tube 48 and an O-ring 110 seated in O-ring groove 74 provides a seal between the outer surface of tube 68 and the inner wall of tube 48. Protective cap 100 (FIG. 3) is inserted into cup-shaped member 40 wherein the cylindrical section 102 is the same diameter as skirt 94 so that it is received within cup-shaped enclosure 40 and retained therein by a friction fit.

The outer diameter of cup-shaped enclosure 40 and the inner diameter of throat 34 of liquid container 30 are chosen so enclosure 40 can be inserted into the throat with a snug fit with the throat edge bearing against shoulder 46, see FIG. 4. Cup-shaped enclosure 40 is then welded to container 30 to permanently attach it thereto. Cylinder 86 and cup-shaped enclosure 40 when assembled define an air chamber 104 separate from both passageways 50 in tube 48 and passageway 70 through piston 66 and the interior of liquid storage compartment 32 of container 30. In this way the air used to mix with the liquid to form the foam is imported from the exterior of the container. The inner diameter of enclosure 40 and the outer diameter of flexible seal 94 are chosen to produce a substantially air-tight connection so that air chamber 104 can be pressurized by pushing piston 66 inwardly into tube 48 within enclosure 40. The upper O-ring 110 seals against liquid leaking into air chamber 104 while the lower O-ring 78 seals against air leaking out or back into air chamber 104.

The combination of assembled container 30 and foam pump 36 may be used alone in a manner to be described below or alternatively may be used in conjunction with dispenser housing 12. FIG. 6 illustrates a cross sectional view of housing 12 incorporating assembled container 30 and pump 36. With reference to FIGS. 6 to 8, lower compartment 16 of housing 12 is defined by side walls 120 and a front wall 122 having a generally rectangular aperture 124 located therein. Pushbutton 18 is pivotally connected to side walls 120 at position 126 and may be rotated about this pivotal connection. The ambit of this rotational movement is best seen by comparing the pushbutton positions in FIGS. 6 and 7 so that in the former, pushbutton 18 is fully extended and in FIG. 7 it is fully depressed.

Dispenser housing 12 includes a locking mechanism for releasibly holding the collapsible bottle 30 and pump 36 in place. The locking mechanism comprises a pair of arms or levers 130 slidably movable in channels 132 formed in the interior of pushbutton 18 at the edges thereof. The other ends of arms 130 are received into slots 134 located in sleeves 136 which fit over the upper end of posts 138. Posts 138 pass through holes located in a yoke-shaped support bracket 140 rigidly attached to back wall 142 of the housing. Extending about the inner edge of the circular cut-out in bracket 140 is a slot 144. The other end of posts 138 opposed to the ends containing sleeves 136 are rigidly attached to a yoke shaped platform 146 containing a central cut-out 147 and an inwardly protruding shoulder 148. Each post 138 is provided with a spring 150 between bracket 140 and platform 146 to bias the platform down away from bracket 140.

When pushbutton 18 is pushed in it pivots down about pivot point 126 thereby rotating arms 130 so that the ends of the arms in sleeves 136 move upwardly to pull posts 138 and platform 146 upwardly against springs 150. Releasing pushbutton 18 results in platform 146 being returned to the lowered position by the action of springs 150. As pushbutton 18 is moved, arms 130 slide in channels 132, compare FIGS. 6 and 7.

Platform 146 is provided with a pair of opposed bosses 160 each spring biased inwardly over shoulders 148 by springs 162. Bosses 160 travel in slots 164.

To insert assembled container 30 and pump 36 into housing 12, a key (not shown) is inserted into aperture 20 (FIG. 1) to engage a locking mechanism 22 (FIG. 6) and when unlocked, hook 24 is disengaged from catch 26 and the front portion of the housing is pivoted downwardly away from back wall 120. Referring to FIG. 8, container 30 and foam pump 36 are then inserted into housing 12 with cylinder 88 pushed up into section 40 and rib 46 is releasibly held in slot 144. Pushbutton 18 is then pushed inwards so that platform 146 is raised and when the convex inner surfaces of bosses 160 are engaged by rib 96 thereby pushing them outwardly against springs 162. When platform 146 has been raised high enough, bosses 160 snap over the top edge of rib 96 thereby locking conical member 88 with platform 146. When container 30 and foam pump 36 is assembled with dispenser housing 12 and pushbutton 18 is moved as described above, cylinder 86 moves in and out of cup-shaped member 40 to create a pumping action.

In operation, to dispense foam from liquid from container 30 a user places the hand to receive foam under housing 12 adjacent to outlet 98 and with the other hand depresses pushbutton 18, see FIG. 6. Referring now to FIG. 4, with cylinder 86 in the lowered position, inlet valve 52 is in the open position so that liquid flows into passageway 50 through slot 60 and aperture 44 in the direction of the arrows. The arrows in passageways 50 and 70 show the liquid flow path from chamber 32. The liquid soap fills passageway 50 in tube 48 and passageway 70 in piston 66. Upon pressurizing the fluid chamber the liquid in passageways 50 and 70 is pressurized as cylinder 86 is pushed upwardly into enclosure 40 whereupon inlet valve 52 is pushed upwardly thereby closing off fluid inlet 44. As the liquid in passageways 50 and 70 is further pressurized the liquid is forced out around the upper edge 73 of top hat valve 71 inserted on the end portion of tube 69 and into the mixing chamber 77.

Air chamber 104 is being simultaneously pressurized as the volume is decreased so that air is forced (in the direction of the arrows shown) directly through holes 76 in tube 68 as shown in FIG. 4 when the holes 76 are not sealed within tube 48. Referring to FIG. 5, once the piston 66 has been pushed far enough into tube 48 so that holes 76 in tube 68 are covered, the air enters the air chamber 77 between tubes 68 and 69 by being forced up the gap 80 between tubes 40 and 68 and through holes 76. The pressurized liquid soap forced out of passageway 70 is mixed with the pressurized air in mixing chamber 77 just above mesh 84 and the commingled mixture is forced through mesh 84 to produce foam. The foam is expelled through slots 107 in the castellated web 106 into passageway 101 and out onto the user's hand. As cylinder 86 is being urged back out of enclosure 40, inlet valve 52 is pulled downwardly thereby opening inlet 44 and liquid is drawn into chamber 50 from container 30. Depressing pushbutton 18 repeats the foam production step described above.

The properties of the foam, ratio of liquid to air may be controlled by the mesh or grid 84 and the relative volumes of the air chambers and fluid chambers. A foam with an air to liquid ratio of 20:1 has been found to be quite useful when liquid hand soap is being dispensed.

When cylinder 86 is urged back away from member 40 by springs 150, air is sucked back into air chamber 104 by being drawn back through outlet 98 and back up through mesh 84 through holes 76 and into the air chamber 104. Residual foam remaining in mesh 84 or outlet passageway 98 is then sucked back into air chamber 104 so that the foam pump is self cleaning. An advantage of having holes 76 displaced up away from the top hat valve 71 is that after air is drawn back into chamber 104 after dispensing to clean the outlet, liquid condensed out from residual foam drawn back into chamber 104 can build up at the bottom of the air chamber 104 above piston head 72 without leaking out of the dispenser outlet. There is no leakage until the liquid level increases above holes 76 in air chamber 104.

Foam pump 36 is advantageous over prior art foamers because the same amount of pressure is required to operate the pump and produce the foam regardless of the amount of liquid in the container. Further, less work in general needs to be exerted since the liquid is not being forced up a tube or being forced through a thick porous plug. Also, the shape of the container is not restricted in shape by the need to hand squeeze it as with many of the prior art foamers. Another advantage of the foamer of the present invention is that the liquid is maintained in a relatively air-tight dispenser with no mixing with air until expelled from the fluid chamber. In this way long term oxidation of the ingredients making up the liquid is reduced. Every time a container is replaced, a new foam pump is provided with the container. This is advantageous since it avoids extended usage of the same pump so that problems such as blockage of passageways is avoided.

A further advantage of the foaming device disclosed herein is that the need for thick, rigid porous plugs for generating foam as found in many of the prior art devices is avoided. The thin mesh or grid 84 as illustrated is sufficient to generate foam of appropriate quality.

It will be appreciated that container 30 and foam pump 36, being fabricated of plastic, may be readily recycled after the contents of container 30 have been consumed.

The combination of filled collapsible container 30 and foam pump 36 attached thereto (FIG. 2) is preferably sold as a single unit (with cap 100) as a replacement charge for use with dispenser housing 12 in applications requiring fixed locations for the dispenser such as rest rooms, other sanitary stations and the like. Alternatively, it will be appreciated that the combination of container 30 and foam pump 36 may be used in applications where the user carries the unit about and hand pumps foam from the device. This is possible because the combination of the air-tight connection of pump 36 with collapsible bottle 30 permits the foam to be dispensed with the bottle in any orientation while many of the prior art designs only function with the bottle in the upright position. This feature is very advantageous in for example hospitals where patients must be washed in bed. In such applications container 30 is held in one hand and cylinder 86 is pumped with the other hand to dispense foam. For such applications, cylinder 86 may be interlocked with cup-shaped enclosure 40 by means of a boss and groove arrangement whereby a boss projects out from the side of cylinder 86 into a groove located on the interior surface of cup member 40. The groove would have two turns in it so that cylinder 86 could not be pulled out of enclosure 40 without rotation.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore what is claimed is:

1. A device for producing and dispensing foam, comprising:

a) a collapsible container having an interior and a throat; and b) pump means attached to said container, the pump means including opposing first and second enclosure members, the first enclosure member being sealed in said throat with an air-tight seal, the second enclosure member having a flexible seal angled outwardly therefrom toward and engaging the first enclosure member, the second enclosure member being mounted within said first enclosure member and telescopingly movable with respect thereto, the first and second enclosure members cooperating to define an air chamber therebetween, the flexible seal providing a friction fit and an air seal between the first and second enclosure members to thereby facilitate pressurizing the air chamber as the second enclosure member is urged toward the first enclosure member, the air chamber being in communication with a mixing chamber, a fluid flow passageway having a fluid inlet in flow communication with the interior of the container, the fluid inlet including a fluid inlet valve for admitting liquid into said flow passageway from the interior of the container, a fluid outlet valve in the flow passageway for controlling flow of liquid from the flow passageway into the mixing chamber, an outlet passageway communicating with the mixing chamber, and a porous member located downstream from the fluid outlet valve and the mixing chamber for foaming air and liquid mixed in the mixing chamber and passing through the porous member, whereby moving the second enclosure member towards the first enclosure member reduces a volume of the air chamber and a volume of the flow passsageway and pressurizes air in the air chamber and liquid in the flow passageway and forces commingled air and liquid through the porous member to form a foam expelled through the outlet passageway.

2. The device according to claim 1 wherein the first enclosure member is provided with a tube defining a first portion of said flow passageway extending from said fluid inlet, the second enclosure member having a distal end portion and a proximal end portion, said flexible seal extending around said proximal end portion and bearing against an interior surface of said first enclosure member.

3. The device according to claim 2 wherein said outlet passageway is located in said distal end portion, and wherein said second enclosure member includes a piston comprising a piston head and an outer piston tube being attached to said piston head at a proximal end of said outer piston tube, said piston defining a second portion of said flow passageway extending therethrough, and wherein a distal end of said outer piston tube is inserted into said tube of said first enclosure member for reciprocating movement therein.

4. The device according to claim 3 wherein said piston includes an inner piston tube concentric with the outer piston tube, a distal end of said inner piston tube being attached to the distal end of said outer piston tube, said inner piston tube defining said second portion of said flow passageway through said piston, said inner and outer piston tubes defining said mixing chamber therebetween, and wherein said outer piston tube includes at least one aperture for communication of said mixing chamber with said air chamber, and wherein said outlet valve is connected to a proximal end of said inner piston tube.

5. The device according to claim 4 wherein the fluid outlet valve is a flexible top hat valve, and wherein when the flow passageway is sufficiently pressurized the liquid inlet valve closes and the top hat valve opens thereby forcing liquid through said top hat valve into said mixing chamber to commingle with air and be expelled through the porous member and the outlet passageway.

6. The device according to claim 5 wherein said distal end portion of the second enclosure member includes a web defining said outlet passageway, and wherein said porous member is a gauze disc positioned between said piston head and said web.

7. The device according to claim 4 wherein said at least one aperture is spaced from the distal end of said outer piston tube, said outer piston tube including at least one slot extending from said at least one aperture to said proximal end of said outer piston tube defining an air flow path into said mixing chamber when said piston is inserted into said tube to a position wherein said tube covers the at least one aperture.

8. The device according to claim 4 wherein said second enclosure member is provided with a shoulder spaced from said proximal end portion thereof, and wherein said flexible seal is attached to said shoulder.

9. The device according to claim 8 wherein said first and second enclosure members are cylindrically shaped and said shoulder is a circumferential shoulder, and wherein said flexible seal is a U-shaped cylindrically shaped seal with an inner vertical wall that snap locks into a groove located in said circumferential shoulder.

10. The device according to claim 5 wherein the inlet valve includes a valve stem attached to a valve seat, the valve stem being located in the fluid inlet and protruding into the interior of the container, the valve seat being located in the first portion of the flow passageway and wherein moving the second enclosure member away from the first enclosure member reduces the pressure in the flow passageway thereby drawing the inlet valve to an open position and pumping liquid from the container into the flow passageway, and wherein moving the second enclosure member towards the first enclosure member pressurizes the flow passageway thereby forcing the inlet valve towards the interior of the container so that the valve seat seals the fluid inlet.

11. The device according to claim 5 including a dispenser housing, the container with attached pump means being releasably insertable into said dispenser housing, wherein the first enclosure member includes a first circumferential lip, the second enclosure member including a circumferential lip, the dispenser housing including a first coupling mechanism for releasibly gripping said first circumferential lip, the dispenser housing including a second coupling means for releasibly gripping said second circumferential lip.

12. The device according to claim 11 wherein the dispenser housing includes at least a pumping mechanism connected to the second coupling means whereby activating the pumping mechanism causes the second enclosure member to undergo reciprocating movement with respect to said first enclosure member.

13. The device according to claim 12 wherein said pumping mechanism includes at least one lever, the second enclosure member being connected to the at least one lever so that moving the at least one lever moves the second enclosure member with respect to the first enclosure member.

14. The device according to claim 13 wherein the pumping mechanism includes a bias means for urging the second enclosure member away from the first enclosure member.

15. The device according to claim 13 wherein said pumping mechanism includes a push button pivotally attached to the dispenser housing and engaged to said at least one lever, said dispenser housing including biasing means for biasing the second enclosure member away from said first enclosure member, whereby depressing the pushbutton causes the second enclosure member to move towards the first enclosure member, and upon release of the pushbutton said biasing means urges said second enclosure member away from the first enclosure member.

16. The device according to claim 1 wherein the air chamber communicates with the mixing chamber through at least one aperture that is spaced from the fluid outlet valve.

17. The device according to claim 4 wherein said at least one aperture in said outer piston tube is located at the distal end of the outer piston tube.

* * * * *